US008191797B2

(12) United States Patent
Sebastian

(10) Patent No.: US 8,191,797 B2
(45) Date of Patent: Jun. 5, 2012

(54) FUEL INJECTOR

(75) Inventor: Thomas Sebastian, Charleston, SC (US)

(73) Assignee: Robert Bosch GmbH, Stuttgart (DE)

( * ) Notice: Subject to any disclaimer, the term of this patent is extended or adjusted under 35 U.S.C. 154(b) by 787 days.

(21) Appl. No.: 10/569,389

(22) PCT Filed: Jul. 7, 2004

(86) PCT No.: PCT/DE2004/001451

§ 371 (c)(1),
(2), (4) Date: Nov. 17, 2006

(87) PCT Pub. No.: WO2005/019641

PCT Pub. Date: Mar. 3, 2005

(65) Prior Publication Data

US 2007/0057088 A1 Mar. 15, 2007

(30) Foreign Application Priority Data

Aug. 19, 2003 (DE) ..... 103 38 081

(51) Int. Cl.
*F02M 47/02* (2006.01)

(52) U.S. Cl. ..... 239/88; 239/533.2

(58) Field of Classification Search ..... 239/88–91, 239/95, 584, 533.2, 533.13, 585.1–585.5, 239/600; 251/129.15, 129.21, 127
See application file for complete search history.

(56) References Cited

U.S. PATENT DOCUMENTS

| | | | | |
|---|---|---|---|---|
| 3,245,096 | A * | 4/1966 | McKay et al. | 470/14 |
| 4,423,843 | A | 1/1984 | Palma | |
| 5,996,910 | A | 12/1999 | Takeda et al. | |
| 6,186,421 | B1 * | 2/2001 | Wahba et al. | 239/585.1 |
| 6,390,067 | B1 | 5/2002 | Haltiner, Jr. et al. | |
| 6,845,757 | B2 * | 1/2005 | Strahberger et al. | 123/467 |
| 2001/0054652 | A1 * | 12/2001 | Kluegl | 239/88 |

FOREIGN PATENT DOCUMENTS

| | | |
|---|---|---|
| DE | 37 83 235 | 5/1988 |
| DE | 195 27 049 | 1/1997 |
| EP | 0 042 799 | 12/1981 |
| JP | 2503101 T | 9/1990 |
| JP | 8100730 | 4/1996 |
| JP | 2002221119 | 8/2002 |
| WO | 88 03225 | 5/1988 |
| WO | WO88/03225 | 5/1988 |
| WO | 98 03934 | 1/1998 |

* cited by examiner

*Primary Examiner* — Davis Hwu
(74) *Attorney, Agent, or Firm* — Kenyon & Kenyon LLP

(57) ABSTRACT

A fuel injector for fuel-injection systems of internal combustion engines includes a solenoid coil and an armature excitable by the solenoid coil, the armature being in operative connection with a valve-closure member, which forms a sealing seat together with a valve-seat body arranged in a valve sleeve. The valve-seat body is held in place in the valve sleeve by a clamping sleeve.

9 Claims, 2 Drawing Sheets

FUEL INJECTOR

FIELD OF THE INVENTION

The present invention is based on a fuel injector which is known from German Published Patent Application No. 195 27 049, for instance.

BACKGROUND INFORMATION

Sealing a fuel injector from its environment requires manufacturing processes that ensure high surface quality and surface geometry. The high-quality valve seat is produced by grinding and subsequent honing.

All subsequent processes, for instance pressing the valve seat into the valve housing or connecting the valve seat to the valve housing by a welded seam, have a detrimental effect on the quality of the surfaces and thus on the tightness of the fuel injector. In particular the roundness values at the sealing diameter, which are important for the sealing, are adversely affected. This has a negative effect on the exhaust-gas values since fuel may make its way past the sealing seat and reach the intake manifold or the combustion chamber, thereby producing an overly rich mixture, which causes poor combustion and high emissions.

Another advantage of the known fuel injectors is that a thermal connection of the valve seat to the valve sleeve is present across a large surface, which adversely affects the heat response with respect to the fuel.

SUMMARY OF THE INVENTION

In contrast, the fuel injector has the advantage over the related art that the valve-seat body is retained in the valve sleeve by a clamping sleeve without the need for press-fits with the attendant surface deterioration. This simultaneously allows a thermal decoupling and simple installation with reliable sealing.

In an advantageous manner, the clamping sleeve is elastic both in the radial and axial direction, which on the one hand ensures that the clamping seat itself stays in position and on the other hand that the valve-seat body and the spray-hole disk are correctly positioned.

Furthermore, it is advantageous that the valve-seat body is sealed from the valve sleeve in a simple and cost-effective manner via a sealing ring.

It is also advantageous that the clamping sleeve is able to be produced in an uncomplicated manner by stamping and bending.

DETAILED DESCRIPTION

Figure 1:
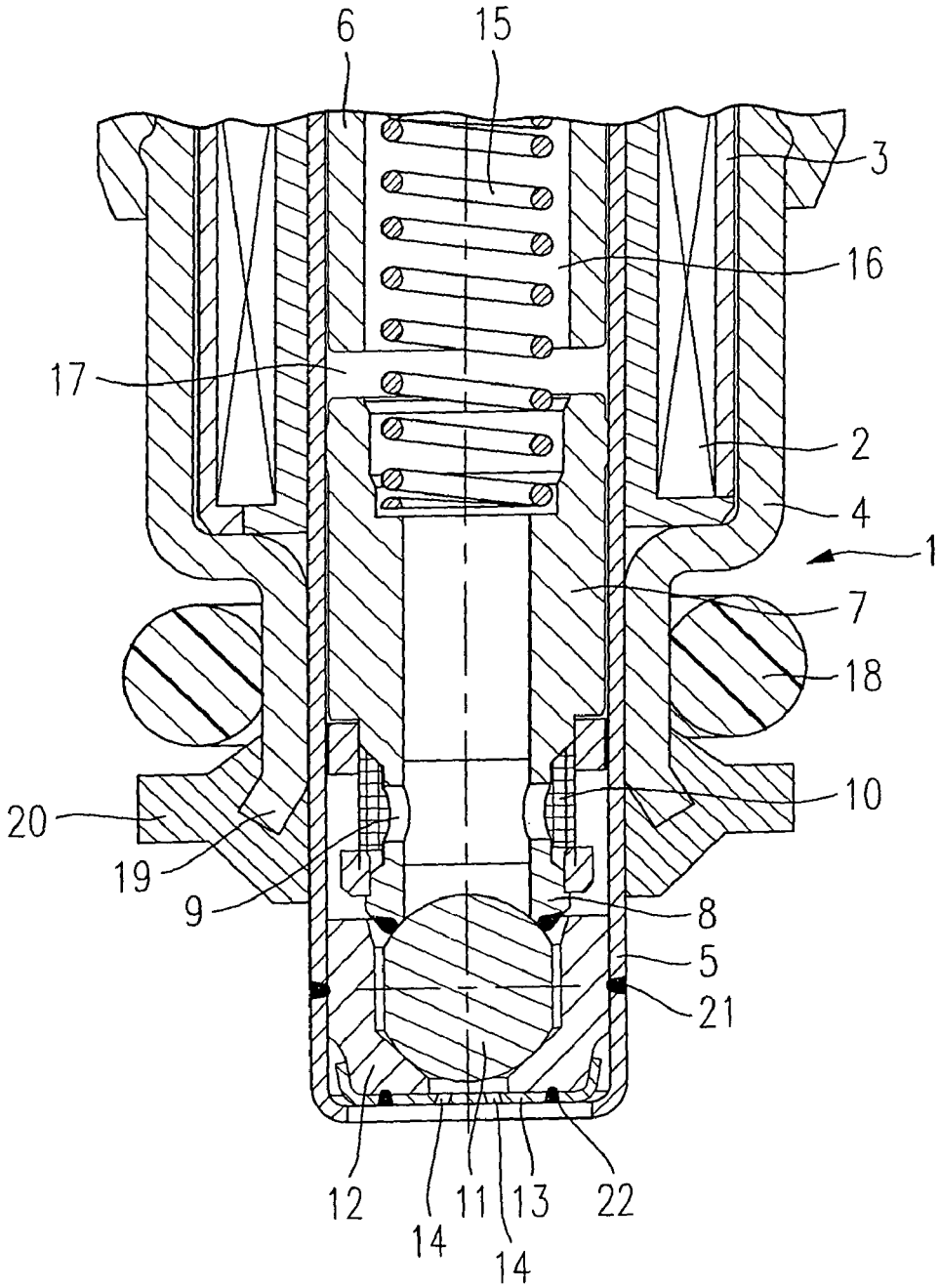
FIG. 1 shows a schematic partial section through an exemplary embodiment of a fuel injector according to the related art.

For better understanding of the measures according to the present invention, FIG. 1 first shows a part-sectional, schematic representation of a longitudinal section through the discharge-side part of a fuel injector 1 according to the related art, which is especially suited for the injection of fuel into an intake manifold (not shown further) of an internal combustion engine.

In the exemplary embodiment, fuel injector 1 includes an actuator in the form of a solenoid coil 2, which is wound on a coil brace 3. Coil brace 3 is encapsulated in a valve housing 4.

Coil brace 3 is penetrated by a valve sleeve 5, which has a tubular design and includes a support tube 6 wedged or soldered therein, which is used as inner pole of magnetic coil 2. Valve housing 4, for example, may be used as outer pole of magnetic coil 2. Downstream from support tube 6 is an armature 7 which is integrally formed with a valve needle 8. Flow-through orifices 9 are provided in valve needle 8, which guide the fuel flowing through fuel injector 1 toward a sealing seat.

An annular filter 10 for filtering the fuel may be disposed in the region of flow-through orifices 9. Valve needle 8 is in operative connection, preferably by welding, with a valve-closure member 11 having a spherical shape in the exemplary embodiment, valve-closure member 4 forming a sealing seat together with a valve-seat body 12. Downstream from the sealing seat, at least one spray-off orifice 14 is formed in a spray-hole disk 13, from which fuel is injected into the intake manifold (not shown further).

In the rest state of fuel injector 1, armature 7 is acted upon by a restoring spring 15 in such a way that fuel injector 1 is held closed by the contact pressure of valve-closure member 11 on valve-seat body 12. Restoring spring 15 is arranged in a recess 16 of armature 7 or support tube 6 and prestressed by an adjusting sleeve 24 (not shown further).

If an electric current is provided to magnetic coil 2 via an electrical line (not shown further), a magnetic field is generated that, if sufficiently strong, pulls armature 7 into magnetic coil 2 counter to the force of restoring spring 15 and counter to the flow direction of the fuel. This closes a working gap 17 formed between armature 7 and support tube 6. The movement of armature 7 also carries along in the lift direction valve needle 8 integrally formed with armature 7, so that valve-closure member 11 lifts off from valve-seat body 12 and fuel is guided to spray-discharge orifice 14.

Fuel injector 1 is closed as soon as the electric current energizing magnetic coil 2 has been switched off and the magnetic field has decayed to such a degree that restoring spring 15 presses armature 7 away from support tube 6, which moves valve needle 8 in the discharge direction, valve-closure member 11 coming to rest on valve-seat body 12.

The sealing of fuel injector 1 shown in FIG. 1 from the intake manifold (not shown further) of the internal combustion engine is achieved by a preferably annular seal 18, which is slid over a protruding edge 19 of valve housing 4 and secured against sliding off by a plastic extrusion coat 20.

Due to the working processes in the production of fuel injector 1, the internal sealing of fuel injector 1 from the intake manifold may be found lacking in some cases. While a high surface quality and an attendant good sealing are obtained by producing valve-closure body 12 with the sealing seat formed thereon by grinding and honing, this becomes relative again because of the subsequent working processes, such as pressing valve-seat body 12 into valve sleeve 5 and connecting the mentioned components by a first welding seam 21, as well as connecting valve-seat body 12 to spray-hole disk 13 by a second welding seam 22.

Figure 2A:
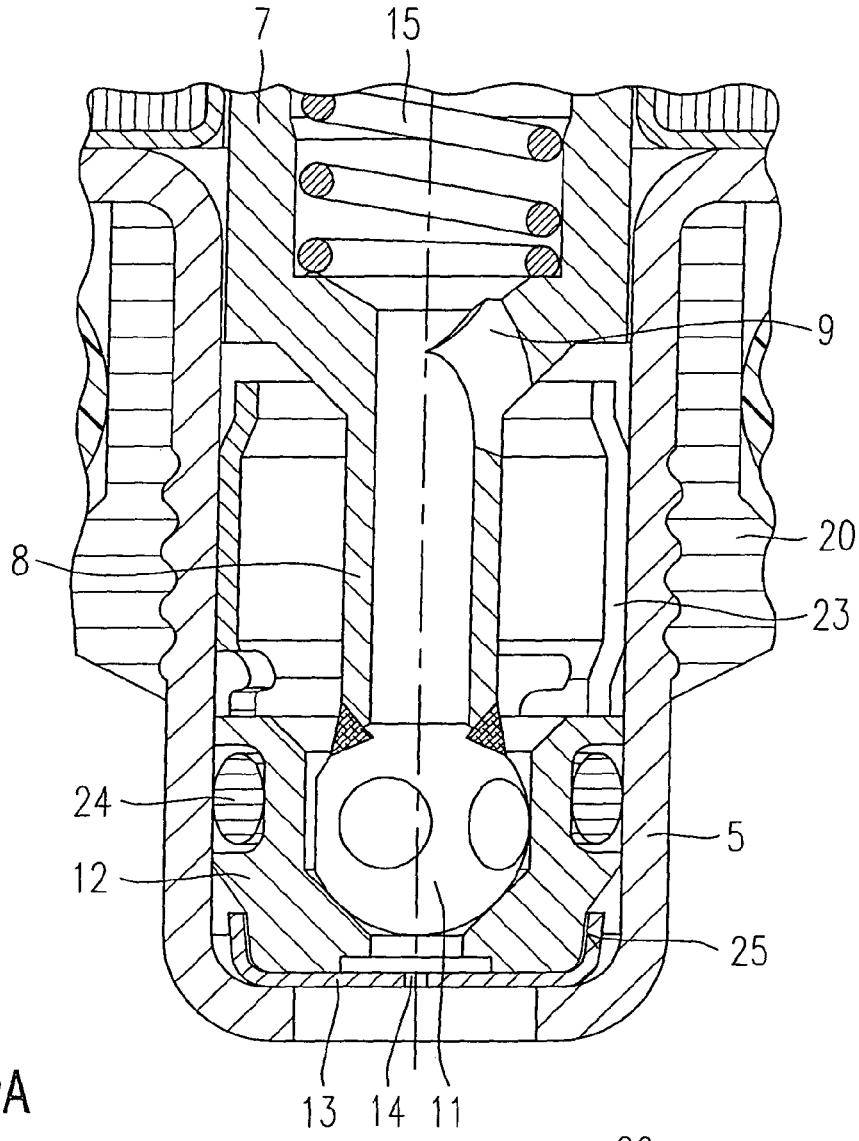
FIG. 2A shows a schematic, partial section through the discharge-side end of an exemplary embodiment of a fuel injector configured according to the present invention.

In contrast, an exemplary embodiment of a fuel injector 1 configured according to the present invention and shown in FIG. 2A includes a clamping sleeve 23, which, in place of welding seams 21 and 22, ensures the correct positioning of valve-seat body 12 in valve sleeve 5 and spray-hole disk 13 between valve-seat body 12 and valve sleeve 5.

The individual components are installed in an uncomplicated manner. First, spray-hole disk 13 is inserted in valve sleeve 5 with a clearance fit. In the next step, valve-seat body 12, which is sealed from valve sleeve 5 by a sealing ring 24, is installed. Valve-seat body 12 also has a clearance fit with respect to valve sleeve 5. A chamfering 25 on the side of valve-seat body 12 facing spray-hole disk 13 centers spray-hole disk 13. The fixation of valve-seat body 12 and—resulting therefrom—the sealing of fuel injector 1 is implemented by pressing clamping sleeve 23 into valve sleeve 5, which is braced on valve-seat body 12. This not only avoids deterioration of the surface quality of valve sleeve 5, but also dispenses with the working steps of welding valve-seat body 12, spray-hole disk 13 and valve sleeve 5. None of the components must be produced with high precision since only a clearance fit and no press fit is required.

This also achieves thermal decoupling of valve-seat body 12 from valve sleeve 5, which allows an improved hot response with respect to the fuel.

Clamping sleeve 23 is elastic both in the radial and axial direction and thus ensures its own correct positioning in valve sleeve 5 and also the positioning of valve-seat body 12 in valve sleeve 5.

Figure 2B:
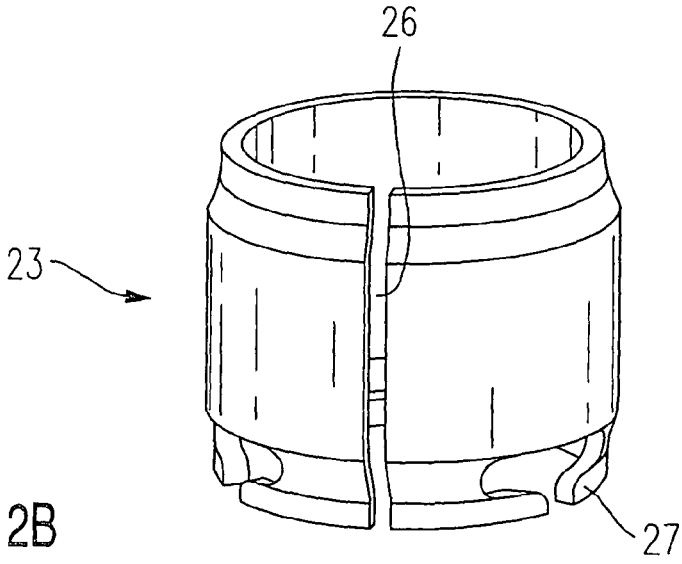
FIG. 2B shows a schematic perspective view of the clamping sleeve from the fuel injector configured according to the present invention and shown in FIG. 2A.

The elasticity in two directions can also be gathered from FIG. 2B where clamping sleeve 23 is shown in a perspective representation in the unmounted state. Clamping sleeve 23 has an axial slot 26, which gives rise to the elasticity in the circumferential direction, as well as elastic tongues 27 that are formed on a side of clamping sleeve 23 facing valve-seat body 12 and allow an elastic bracing of clamping sleeve 23 on valve-seat body 12.

The present invention is not limited to the exemplary embodiment shown, but may also be applied to various other configurations of fuel injectors 1, for example fuel injectors 1 having piezoelectric actuators. In particular, any combination of the individual features are possible.

What is claimed is:

1. A fuel injector for a fuel-injection system of an internal combustion engine, comprising:

a valve sleeve;

a valve-seat body arranged in the valve sleeve;

a valve-closure member that forms a sealing seat together with the valve-seat body;

an actuator that is in an operative connection with the valve-closure member; and a clamping sleeve, arranged in the valve sleeve, by which the valve-seat body is held in place in the valve sleeve;

wherein the clamping sleeve and the valve-seat body do not overlap in an axial direction; and wherein the clamping sleeve includes an axial slot that is situated at a circumferential wall of the clamping sleeve, runs along an entire length of the clamping sleeve and extends in a radial direction completely through the circumferential wall of the clamping sleeve along the entire length of the clamping sleeve.

2. The fuel injector as recited in claim 1, further comprising:

a sealing ring by which the valve-seat body is sealed from the valve sleeve.

3. The fuel injector as recited in claim 1, further comprising:

a spray-hole disk that is held with a clearance fit by chamfering of the valve-seat body.

4. The fuel injector as recited in claim 3, wherein the spray-hole disk is centered in the valve sleeve by the valve-seat body.

5. The fuel injector as recited in claim 1, wherein the clamping sleeve is pressed into the valve sleeve.

6. The fuel injector as recited in claim 1, wherein the clamping sleeve includes elastic tongues.

7. The fuel injector as recited in claim 6, wherein the elastic tongues rest against the valve-seat body.

8. The fuel injector as recited in claim 1, wherein the clamping sleeve is elastic radially and axially.

9. The fuel injector as recited in claim 1, wherein the clamping sleeve is able to be produced by stamping and bending.

* * * * *